US011243053B2

(12) United States Patent
Spychalski

(10) Patent No.: US 11,243,053 B2
(45) Date of Patent: Feb. 8, 2022

(54) WEAPON RELOADING SYSTEM

(71) Applicant: Daniel Spychalski, Elgin, IL (US)

(72) Inventor: Daniel Spychalski, Elgin, IL (US)

( * ) Notice: Subject to any disclaimer, the term of this patent is extended or adjusted under 35 U.S.C. 154(b) by 0 days.

(21) Appl. No.: 17/014,013

(22) Filed: Sep. 8, 2020

(65) Prior Publication Data

US 2021/0063119 A1 Mar. 4, 2021

Related U.S. Application Data

(63) Continuation of application No. 16/559,502, filed on Sep. 3, 2019, now Pat. No. 10,788,295.

(60) Provisional application No. 62/765,593, filed on Aug. 31, 2018.

(51) Int. Cl.

| | |
|---|---|
| ***F41H 5/08*** | (2006.01) |
| ***F41A 23/02*** | (2006.01) |
| ***F42B 39/02*** | (2006.01) |

(52) U.S. Cl.

CPC ..... *F41H 5/08* (2013.01); *F41A 23/02* (2013.01); *F42B 39/02* (2013.01)

(58) Field of Classification Search

CPC ..... F42B 39/00; F42B 39/02; F41A 23/02; F41A 23/16; F41A 23/18; F41A 23/005; F41A 9/82; F41A 9/64; F41H 5/06; F41H 5/08; F41C 25/02; F41C 27/00; F41C 33/0254

USPC ..... 42/87, 108

See application file for complete search history.

(56) References Cited

U.S. PATENT DOCUMENTS

| | | | | |
|---|---|---|---|---|
| 6,050,464 | A * | 4/2000 | Ramsey, Sr. | F41A 9/61 206/3 |
| 7,780,048 | B2 * | 8/2010 | Howell | A41D 13/0012 224/242 |
| 9,097,477 | B1 * | 8/2015 | Mead | F41A 9/63 |
| 9,683,798 | B2 * | 6/2017 | Butler | F41A 9/83 |
| 9,933,218 | B2 * | 4/2018 | Butler | F41A 9/64 |
| 10,309,745 | B2 * | 6/2019 | Messinger | F41A 27/18 |
| 10,551,157 | B1 * | 2/2020 | Gargrave | F42B 39/02 |
| 2006/0022007 | A1 * | 2/2006 | Hughes | F41C 33/0245 224/671 |
| 2006/0242877 | A1 * | 11/2006 | Clifton, Jr. | F41A 9/63 42/49.01 |
| 2012/0152103 | A1 * | 6/2012 | Testa | F41A 9/50 89/129.01 |
| 2012/0260554 | A1 * | 10/2012 | Huffines | F42B 39/02 42/49.01 |
| 2013/0248566 | A1 * | 9/2013 | Solomon | F42B 39/02 224/191 |

(Continued)

*Primary Examiner* — John Cooper

(74) *Attorney, Agent, or Firm* — Erickson Law Group, PC

(57) ABSTRACT

A magazine mount includes a mechanism to releasably hold a weapon magazine in a substantially upright orientation, wherein the mechanism to releasably hold the magazine includes a rectangular housing having an open top and sidewalls, and an axle pin that is fit through a spool, allowing the spool to freely rotate on the axle pin, the axle pin is fit at opposite ends into longitudinal slots through each respective sidewall of the housing. At least one spring backed up by a portion of the housing, exerts a resilient force on the axle pin, urging the axle pin and the spool forwardly in the housing to press on a back end of a weapon magazine held in the housing. The housing has a retainer at a forward end having an underlying clearance to receive a forward side lip of a weapon magazine.

6 Claims, 16 Drawing Sheets

(56) References Cited

U.S. PATENT DOCUMENTS

| | | | | |
|---|---|---|---|---|
| 2014/0223791 | A1* | 8/2014 | Ruby | F41C 27/00<br>42/49.01 |
| 2015/0219413 | A1* | 8/2015 | Karimullah | F41A 7/00<br>89/132 |
| 2015/0219425 | A1* | 8/2015 | Beckman | F41A 9/70<br>89/1.11 |

* cited by examiner

FIG. 1
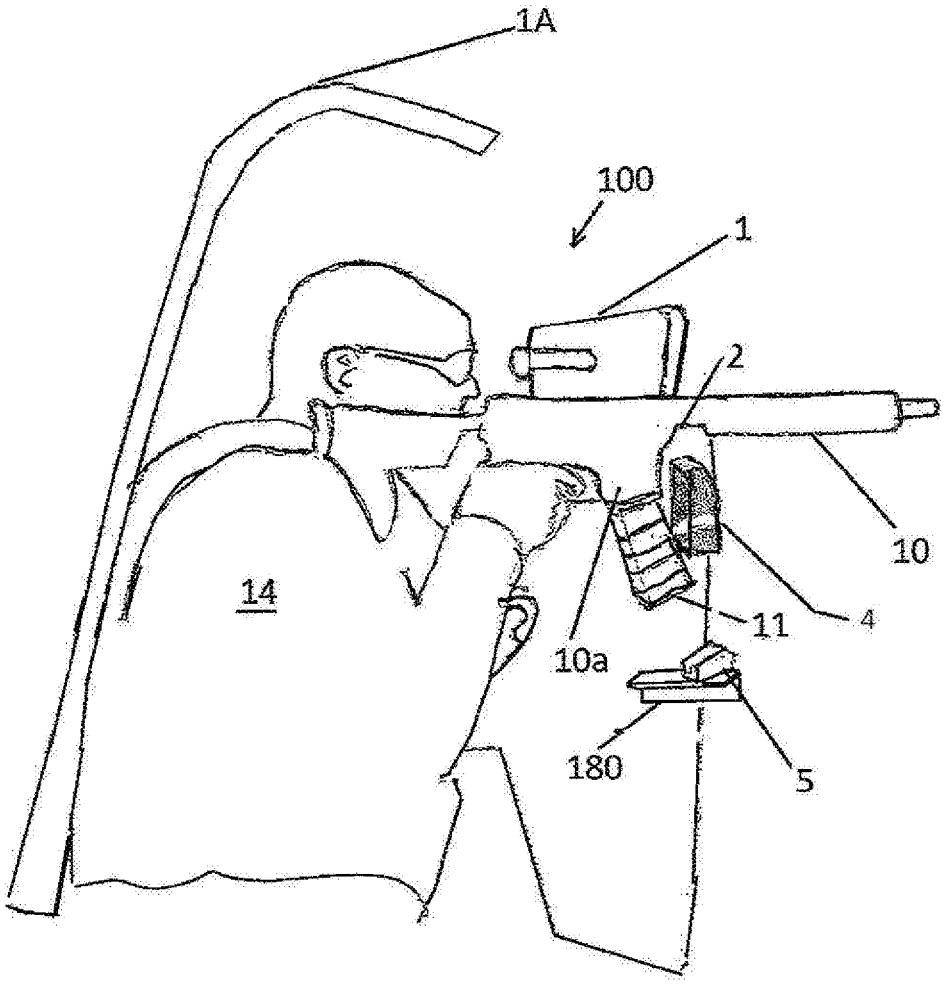
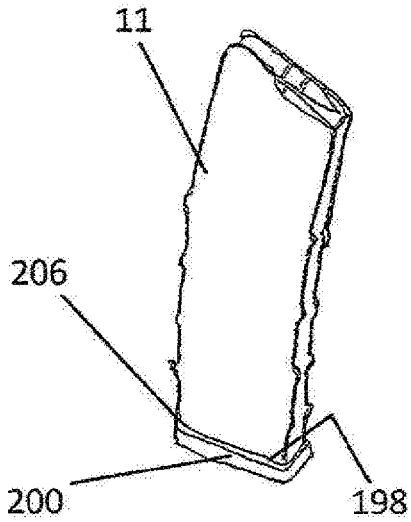
FIG. 2F

WEAPON RELOADING SYSTEM

This application is a continuation of U.S. Ser. No. 16/559,502 filed Sep. 3, 2019, which claims the benefit of U.S. Provisional Application Ser. No. 62/765,593 filed Aug. 31, 2018.

BACKGROUND

Police and SWAT teams are deployed to end dangerous, active shooter situations facing heavily armed criminals. Such situations can occur in public areas and put the lives of civilians at great risk. Officers must react quickly to an active shooter situation.

It is known to provide such law enforcement officers with ballistic vests and ballistic shields. It is also known to provide ballistic shields with some provisions for allowing officers to fire weapons while carrying the shield. Such a system is described in U.S. Pat. No. 9,885,539.

The shield and weapon combination described in U.S. Pat. No. 9,885,539 includes a shield having a gun rest and a releasable attachment to allow the officer to support and aim a rifle or long barrel weapon at the active shooter.

While the assembly described in this patent allows officers to fire a weapon at a shooter while holding a ballistic shield, the combination does not alleviate the burden of changing bullet magazines to reload the weapon. Conventionally, such a magazine change requires two hands on the weapon. The officer would be required to release the weapon from the shield, or at least set down the shield to change out magazines.

US Patent applications 2015/0219413 and 2012/0260554 disclose a one hand magazine loading of pistols.

The present inventor has recognized the need for a shield and weapon combination to accommodate the necessary changing of a bullet magazine to reload a weapon without exposing the officer to fire by setting down his shield. The present inventor has recognized the need for an officer under fire to be able to quickly and safely reload his or her weapon by loading a new bullet magazine onto his or her weapon.

SUMMARY

A magazine mount includes a mechanism to releasably hold a weapon magazine in a substantially upright orientation, wherein the mechanism to releasably hold the magazine includes a rectangular housing having an open top and sidewalls, and an axle pin that is fit through a spool, allowing the spool to freely rotate on the axle pin, the axle pin is fit at opposite ends into longitudinal slots through each respective sidewall of the housing. At least one spring backed up by a portion of the housing, exerts a resilient force on the axle pin, urging the axle pin and the spool forwardly in the housing to press on a back end of a weapon magazine held in the housing. The housing has a retainer at a forward end having an underlying clearance to receive a forward side lip of a weapon magazine.

An embodiment of the present invention provides a combination ballistic shield and weapon, the combination configured to carry in a fixed position on the shield a reload magazine holding bullets to reload the weapon after the active magazine has been spent and ejected. The embodiment provides a gun rest on the shield and a guide for directing a controlled movement of the weapon from a deployed, shooting-ready, position on the gun rest to a reload position where the reload magazine can be engaged by the weapon to reload the weapon by engaging the reload magazine into a magazine well of the weapon.

The shield holds the reload magazine in a mount, the magazine in a generally upright position, enabling the weapon user to perform a weapon reload in a manner without the need for the user to grasp onto the magazine to be loaded.

The magazine mount holds the base portion of the magazine, without the need for magazine modification, by way of a magazine base fitting into a recess in a magazine mount. The mount includes an attachment device functioning as a latching mechanism, releasably latching the magazine base into the recess.

The mount does not inhibit the weapon from properly seating onto and engaging the magazine for reloading. After engagement of the reload magazine into the weapon, a specific motion, such as a pivot motion of the weapon, releases the magazine from the base mount. Additional actions for magazine release may be configured in other embodiments such as using a user-activated release button to release a latching device to release the magazine from the mount.

One aspect of the invention provides a combination that includes the guide between the gun rest and the magazine mount that defines the movement of the weapon from the deployed, shooting-ready position to the reload position. Once the reload magazine is engaged into the magazine well of the weapon, movement of the weapon in a pivoting motion not only releases the reload magazine but also activates the bolt release of the weapon, loading a round into the chamber. The weapon is effectively shooting ready at this point.

While application of the embodiment to a hand held shield is described, this system can be mounted in a multitude of ways, upon a wide variety of fixed objects, portable objects such as shields as well as personnel worn objects including a belt or a vest.

Numerous other advantages and features of the present invention will be become readily apparent from the following detailed description of the invention and the embodiments thereof, and from the accompanying drawings.

BRIEF DESCRIPTION OF THE DRAWINGS

FIG. 1 is a perspective view of a user holding one embodiment of the present invention;

FIG. 2F is a perspective view of a typical magazine;

DETAILED DESCRIPTION

Figure 2A:
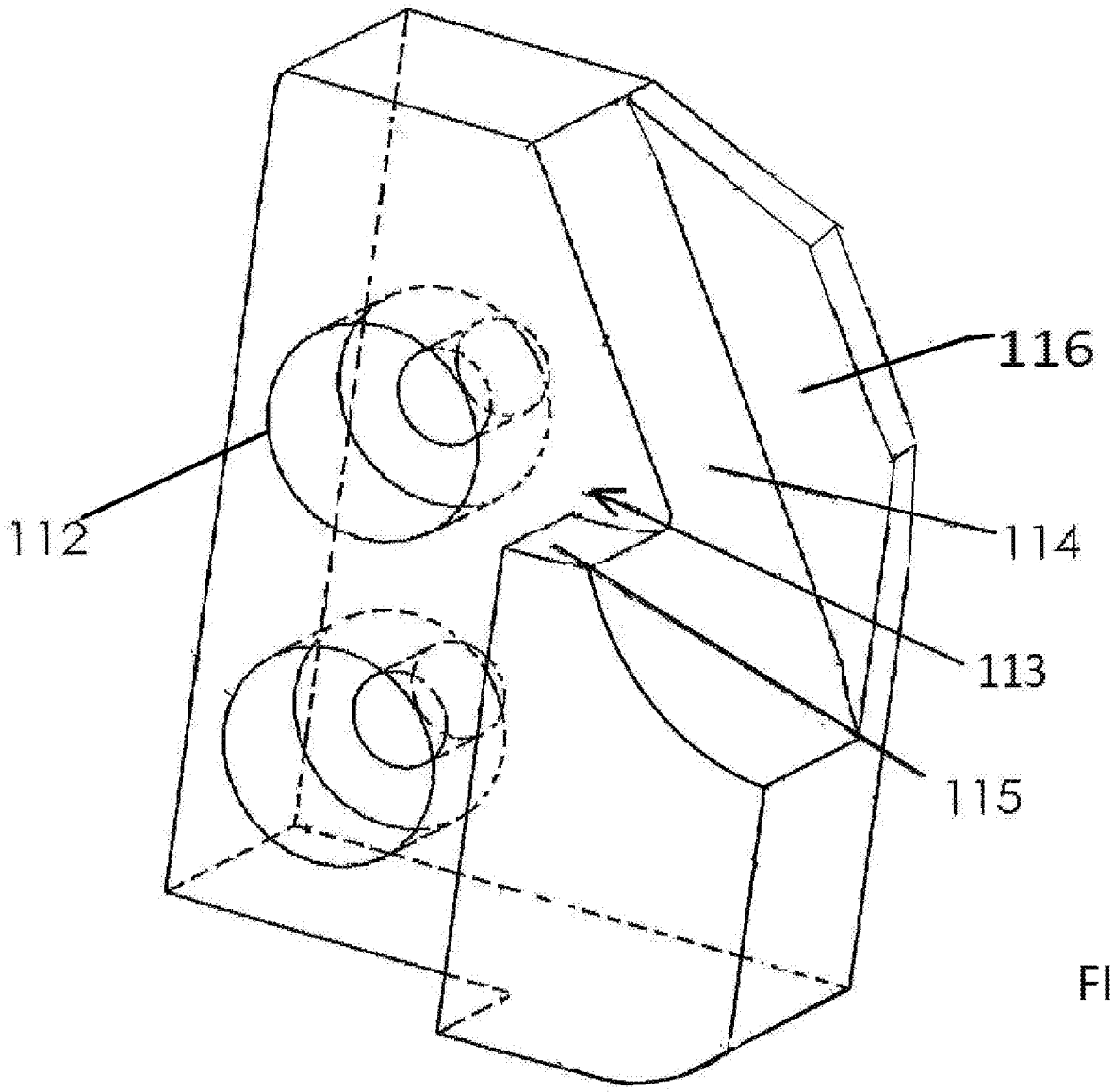
FIG. 2A is a perspective view of a reload guide from the embodiment of FIG. 1.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

This application incorporates by reference U.S. Ser. No. 16/559,502 filed Sep. 3, 2019 and U.S. Provisional Application Ser. No. 62/765,593 filed Aug. 31, 2018, in their entireties.

FIGS. 1-2F illustrates one embodiment of the invention that includes an assembly 100. The assembly 100 includes a shield 1, a shoulder mounted shield support 10A, a weapon rest 2, a weapon guide 4, and a magazine mount 5. A weapon, such as a rifle 10 with a magazine 11, operated by a user 14, is used with the assembly 100.

FIG. 1 displays the assembly 100 with the user 14 holding the shield 1 and the weapon 10. The rifle includes a magazine well 10*a* having an opening, and engaging hardware (not shown) for receiving and engaging a bullet magazine 11 and readying the magazine for dispensing bullets into a chamber of the weapon. The magazine mount 5 is illustrated in an empty state without a re-load magazine to see underlying components.

FIG. 2A illustrates the guide 4 separated from the shield 1. The guide 4 includes a base portion 110 that is fastened to a back of the shield 1 by a fastener 112 or the like. The base portion 110 includes a clearance area 113 above a platform 115 that allows the magazine well 10*a* to be rotated out laterally outward during longitudinal pivoting of the weapon (see FIG. 6B). The magazine well 10*a* rotates above the platform 115 to an angled guide surface 114 sloping downward and laterally outward from a vertical centerline of the shield. In front of the angled surface, and perpendicular thereto, is a backstop surface portion 116. In operation, once a spent magazine 11 is ejected from the rifle, the rifle is pivoted about its longitudinal centerline counterclockwise (viewed by the user holding the stock and looking toward the barrel) and rolled and lifted out of the gun rest with the magazine well rotated about 30-90 degrees, depending on the varying curvature of different magazines, from a normal vertical orientation toward a horizontal orientation, passing over the platform 115. The rifle is then moved forward by the user until the magazine well 10*a* touches the backstop surface portion 116, and can be slid down along or above the sloping surface 114 toward the reload magazine. The backstop surface portion 116 and the sloping surface 114 are positioned to precisely and reliably align the bottom opening of the magazine well 10*a* with a reload magazine 11 carried on the magazine mount 5. The coupling of the magazine well of the weapon and the reload magazine can be precisely and quickly accomplished even during high stress situations.

Figure 2B:
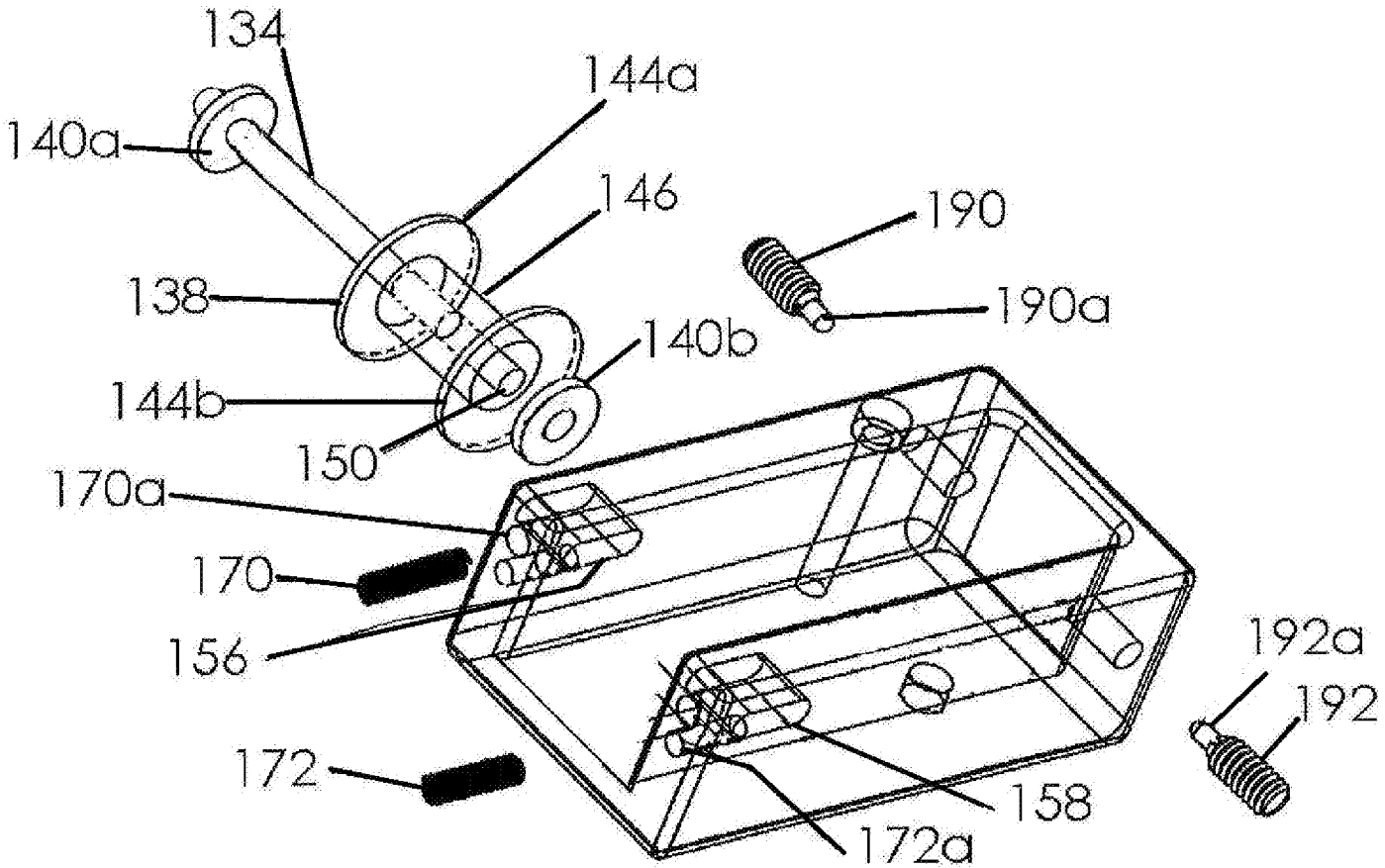
FIG. 2B is an exploded perspective view of a magazine mount taken from the embodiment of FIG. 1.
Figure 2C:
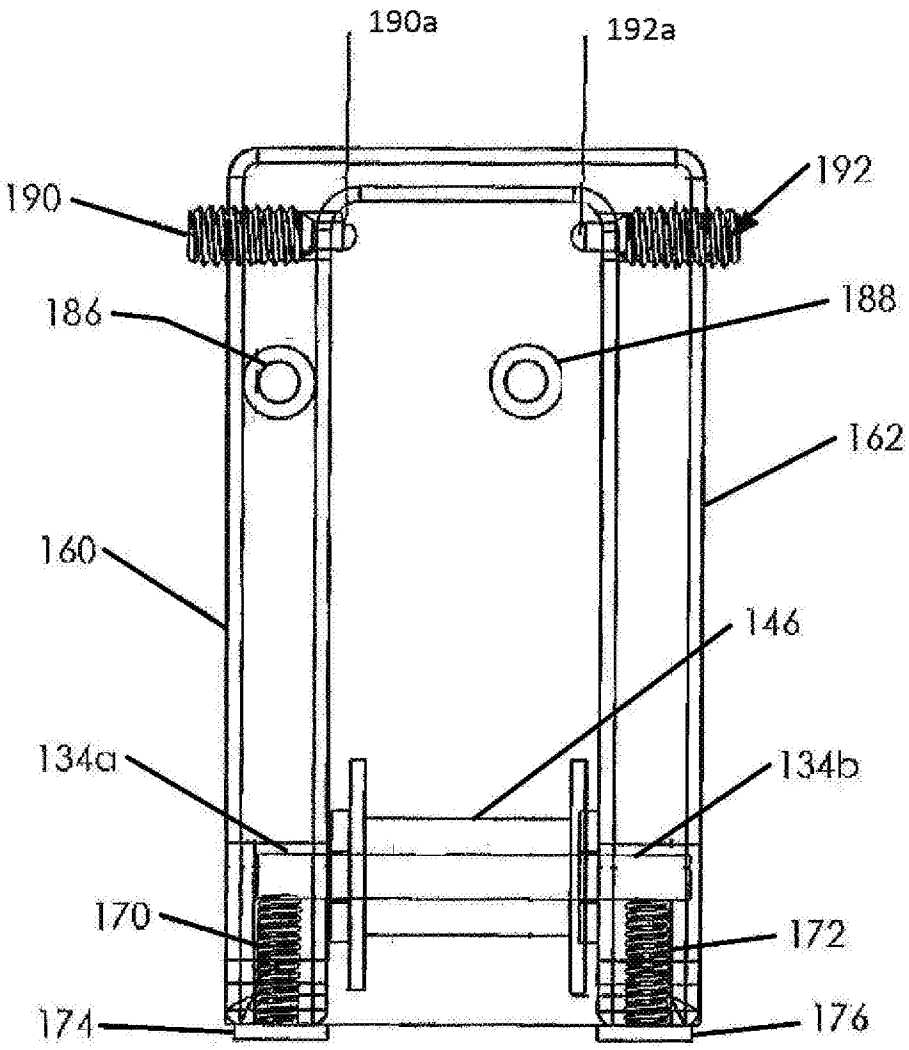
FIG. 2C is a plan view of the magazine mount shown in FIG. 2B in an assembled condition.
Figure 2D:
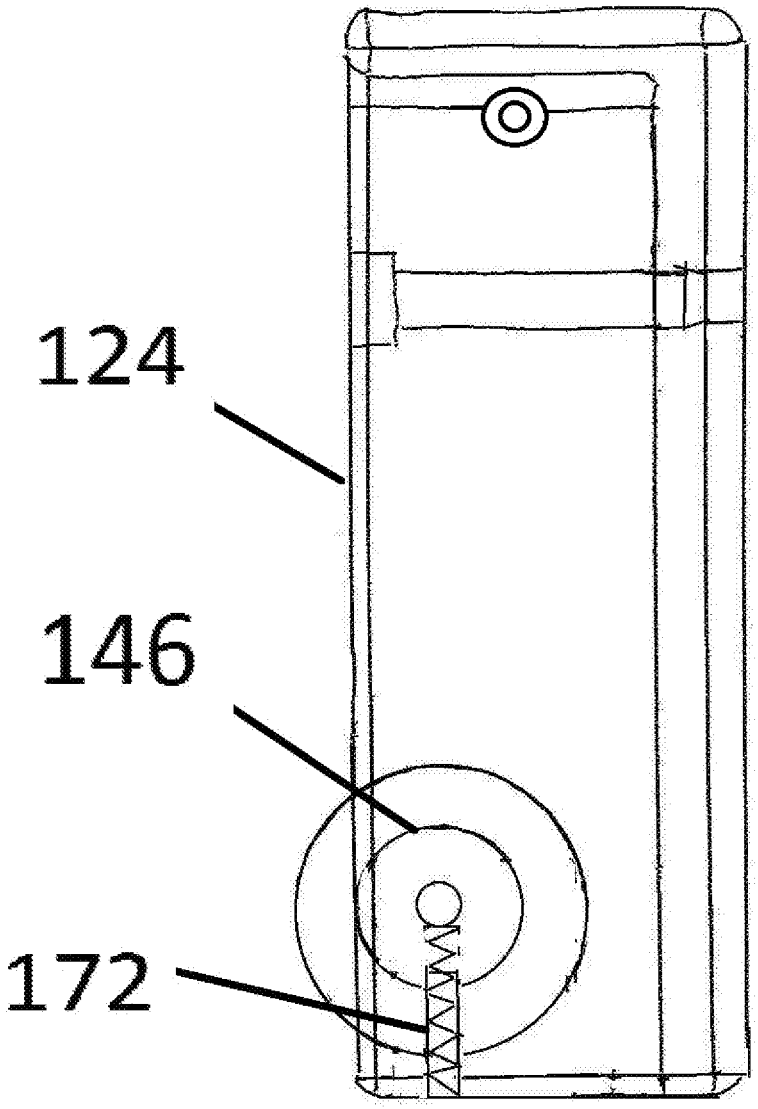
FIG. 2D is a transparent side view of the magazine mount shown in FIG. 2C.
Figure 2E:
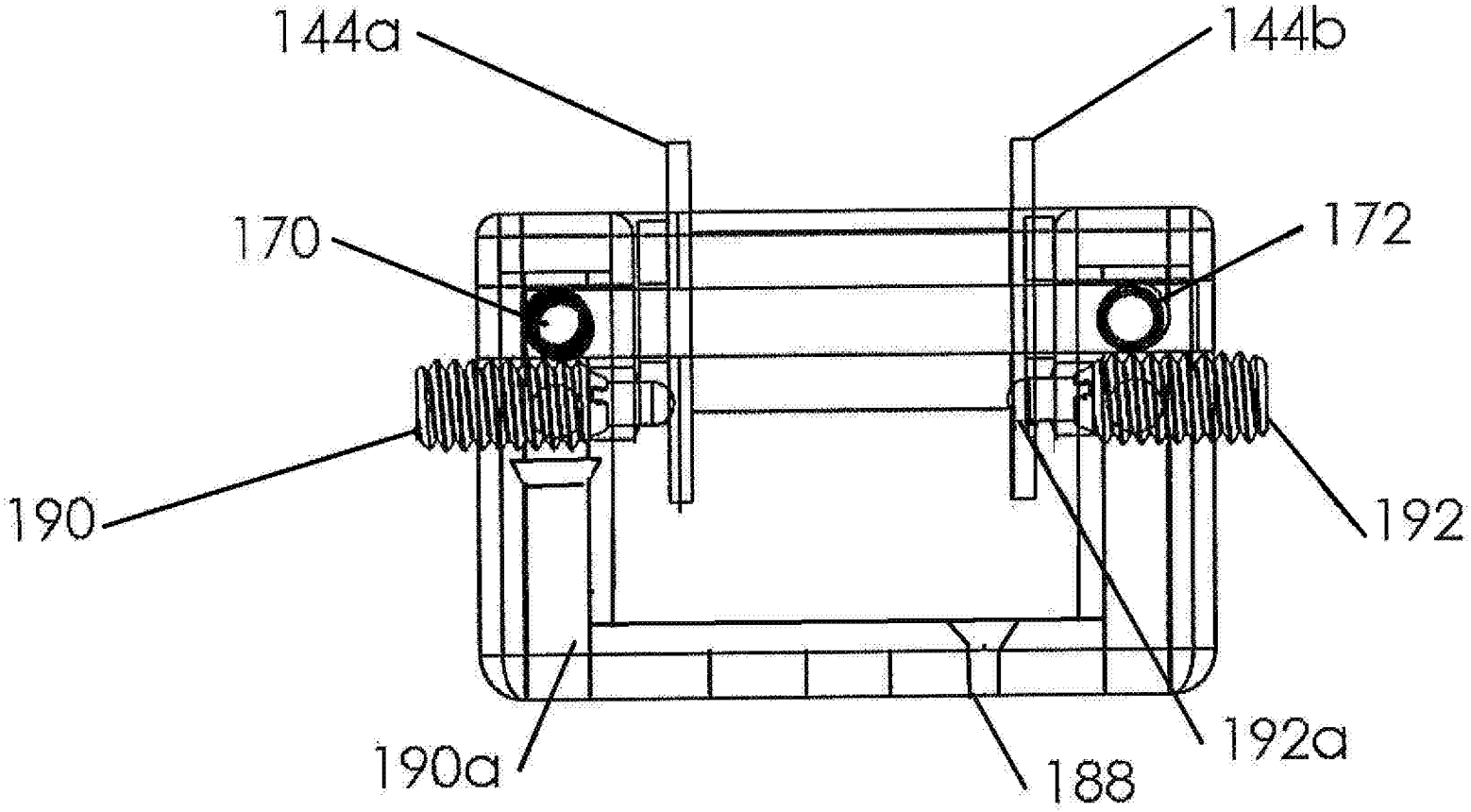
FIG. 2E is a transparent end view of the magazine mount shown in FIG. 2D.

FIG. 2B illustrates the mount 5 in more detail. The mount 5 includes a rectangular housing 120 having an open top 124. The housing includes an open rear end 128 to allow for ease of assembly of a latching mechanism 130. The latching mechanism 130 includes an axle pin 134 that is fit through a spool 138, allowing the spool 138 to freely rotate on the axle pin 134. Two washers 140*a*, 140*b* are fit onto the axle pin 134 on either side of the spool 138. The spool includes two disks 144*a*, 144*b* and a central cylindrical hub 146. The hub 146 and the disks together define a central cylindrical channel 150 for reception of the axle pin 134. When assembled, the axle pin 134 is fit at opposite end into longitudinal slots 156, 158 through sidewalls 160, 162 of the housing respectively.

Two springs 170, 172 are located within longitudinal channels 170*a*, 172*a* located in the sidewalls 160, 162 respectively and extend into the longitudinal slots 156, 158 respectively. The springs are backed up at the rear end of the sidewalls 160, 162 by stops 174, 176 respectively in the form of plates, wall portions, threaded caps, or the like that closes the longitudinal channels 170*a*, 172*a*. The springs 170, 172 exert a resilient force on ends 134*a*, 134*b* respectively of the axle pin 134, urging the axle pin and the spool forwardly in the housing. Provisions are made to prevent the axle pin 134 from moving axially once installed.

The housing can be mounted on a bracket 180, shown in FIG. 1. The bracket can be mounted by fasteners to the shield 1. Two fasteners (not shown) can be used to secure the housing 120 to the bracket 180, the fasteners fit through vertical holes 186, 188 through the housing to be threaded into tapped holes in the bracket 180. The bracket 180 is shown as having a right angle cross-section (an "angle iron"), but other shaped brackets could be used as well.

The housing also includes set screws 190, 192 threaded into holes in the sidewalls 160, 162 respectively. Each set screw has a protruding pin portion 190*a*, 192*a* The pin portions extend interiorly of the housing and function to hold a magazine in the mount by overlying a side rim 198 of a magazine bottom wall 200 at a front of the magazine 11 (FIG. 2F), to hold down a front of the magazine within the housing 120.

The spool hub 146, upon the urging of the springs 170, 172 presses a rear of the magazine, urging the magazine forwardly within the housing. The hub 146 and can overly a rear bottom lip 206 of the magazine 11 (FIG. 2F) holding a rear of the magazine down in the mount.

FIGS. 3-9 illustrate another embodiment assembly 300 of the invention. In this embodiment, the assembly includes the shield 1, a weapon or gun rest 302, a weapon shelf 303, a weapon guide 303, and a magazine mount 305. A weapon, such as the rifle 10, with the magazine 11, operated by the user 14, is used with the assembly 300 as per the prior described embodiment. The gun rest 302, the guide 304 and the magazine mount 305 can all be fastened to an attachment rail 307 which is attached to the shield 1 by being fastened to a side of the weapon rest 302 and to a side of an attachment block 451. The attachment rail 307 can also be attached to an edge of the shield 1 using fasteners (not shown). The gun rest 302 can be fastened to the shelf 303 by a fastener (not shown) through a countersunk hole 304*a* in a bottom of the gun rest 302 and into a tapped hole (not shown) in the top of the shelf 303.

Figure 3:
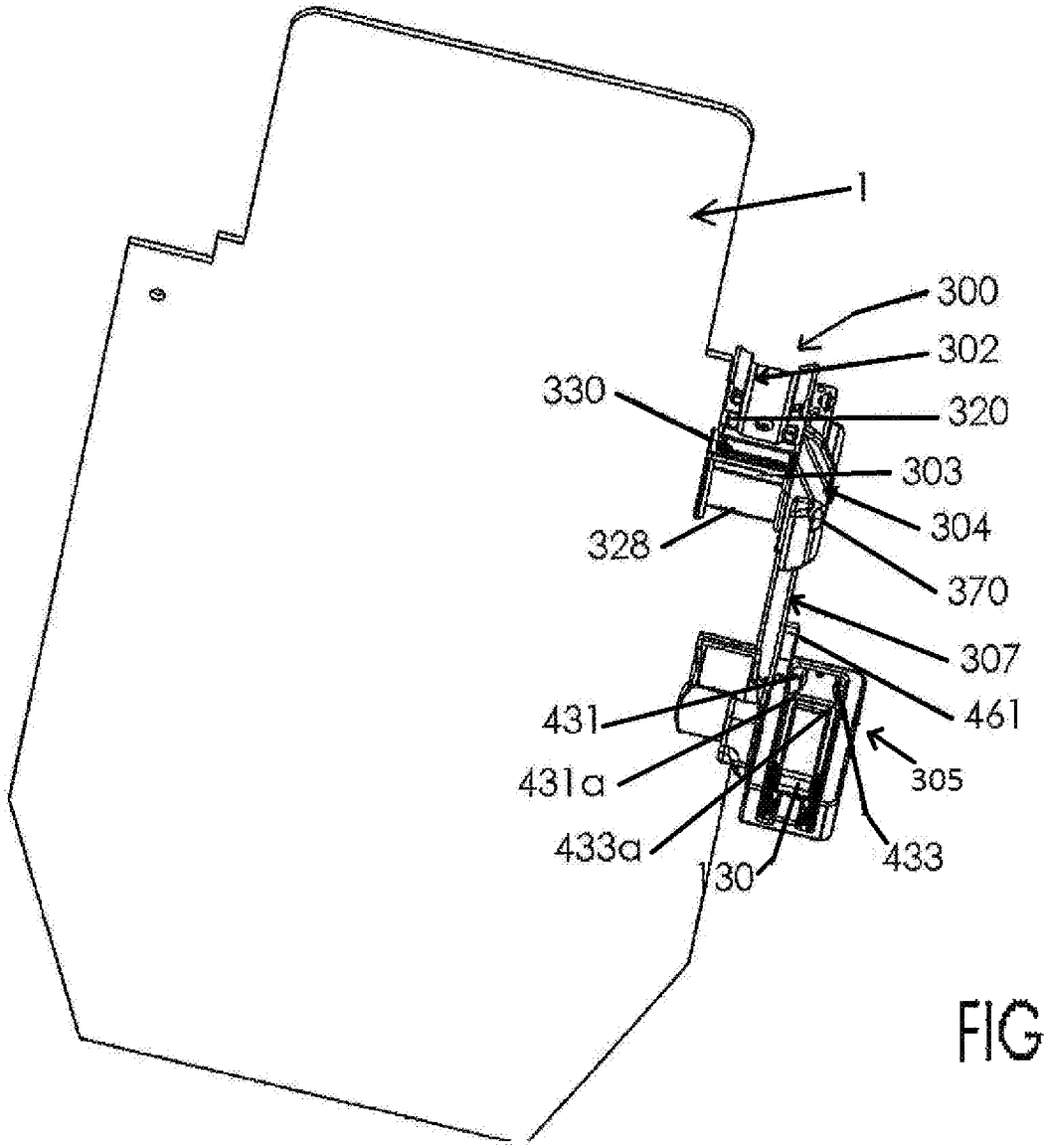
FIG. 3 is a perspective view of an alternate embodiment of the present invention.
Figure 3A:
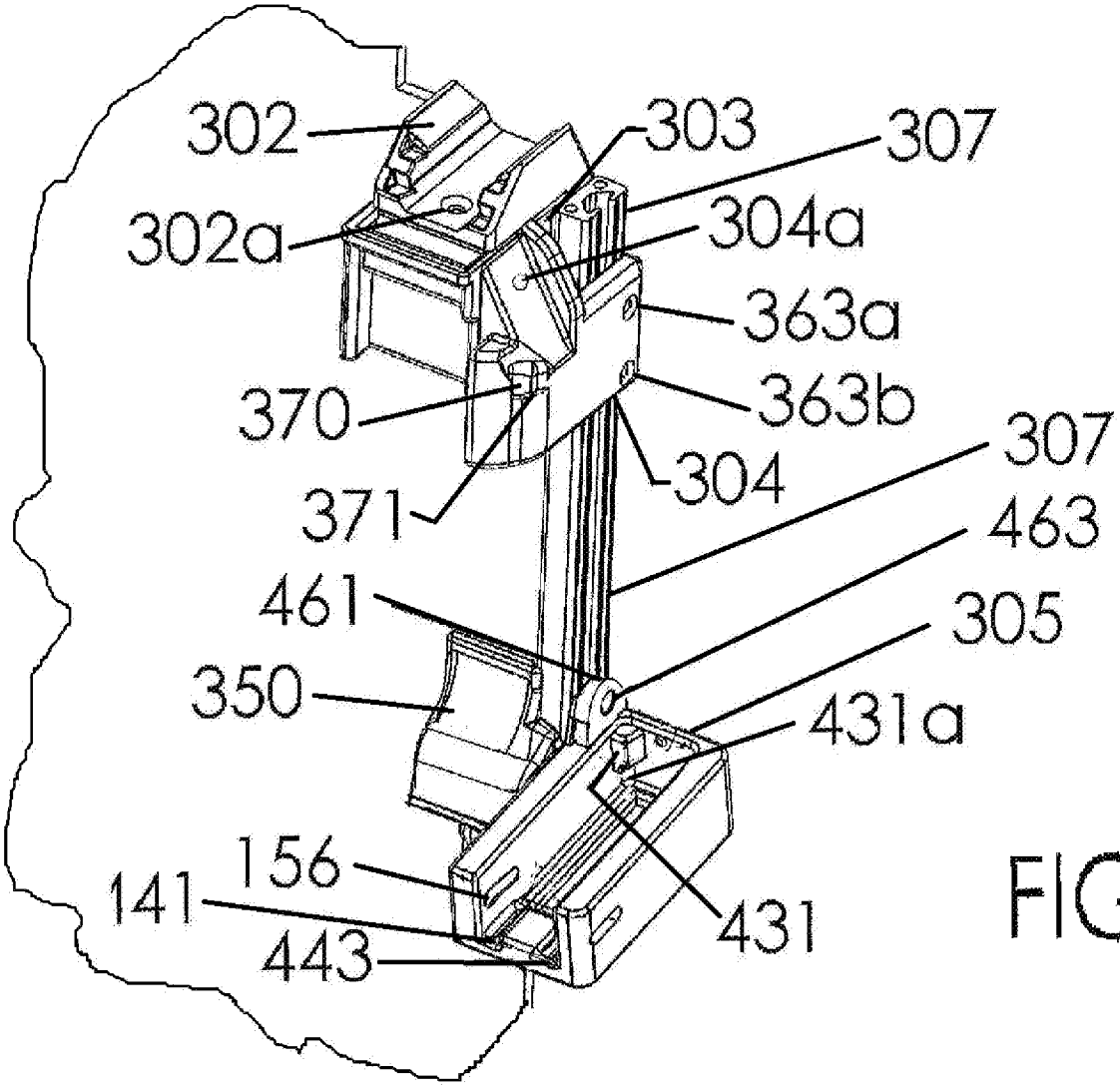
FIG. 3A is a fragmentary perspective view of the embodiment of FIG. 3.
Figure 3B:
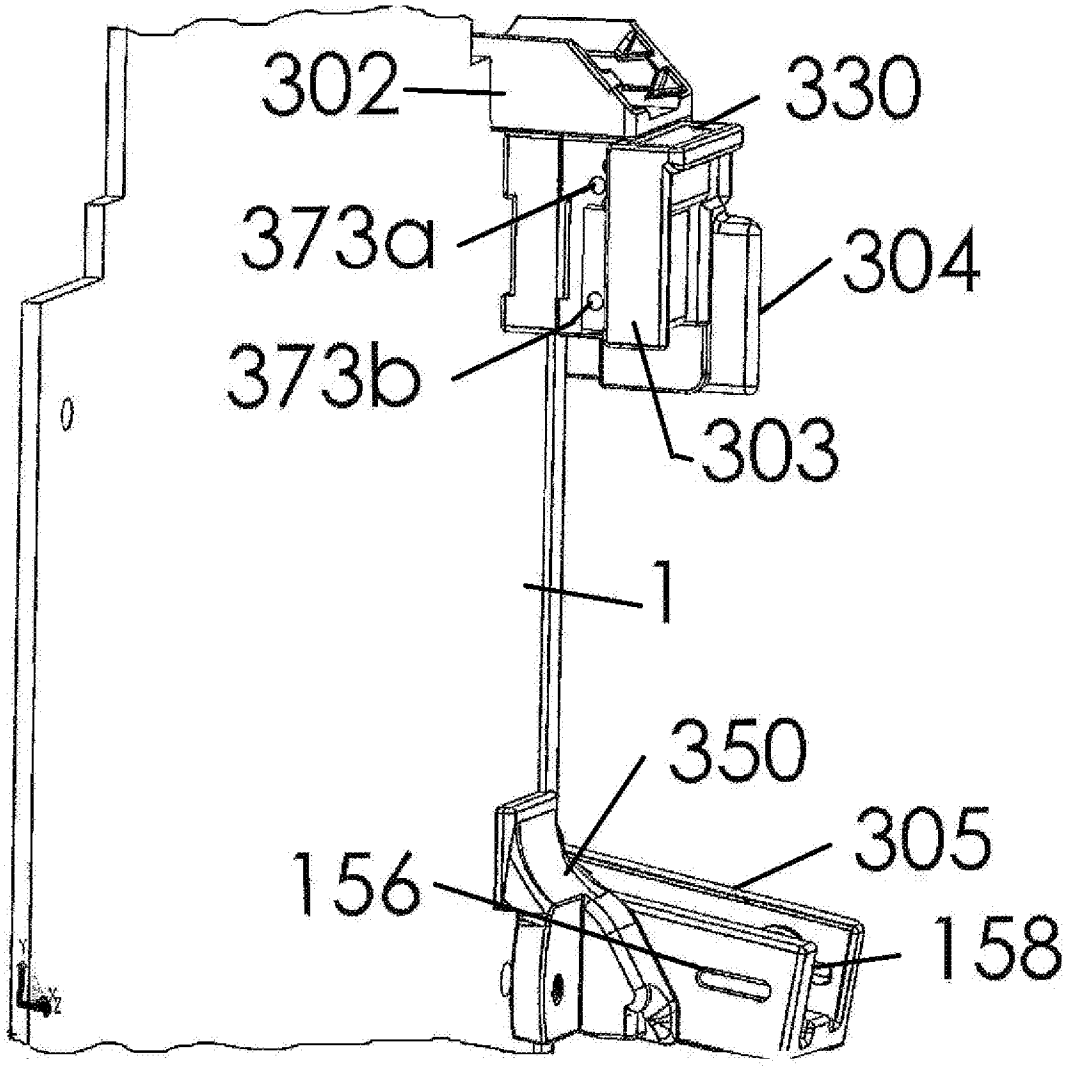
FIG. 3B is a rear fragmentary perspective view of the embodiment of FIG. 3.
Figure 3C:
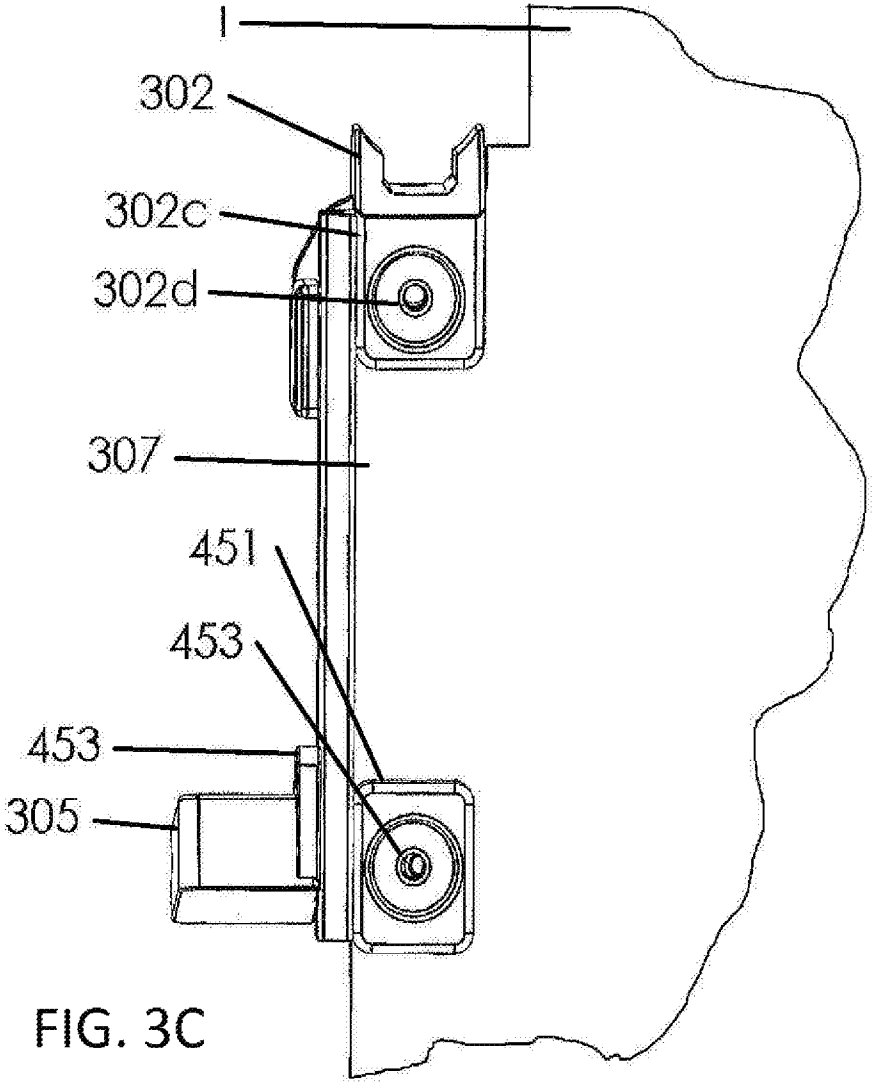
FIG. 3C is a front view of the embodiment of FIG. 3.
Figure 4:
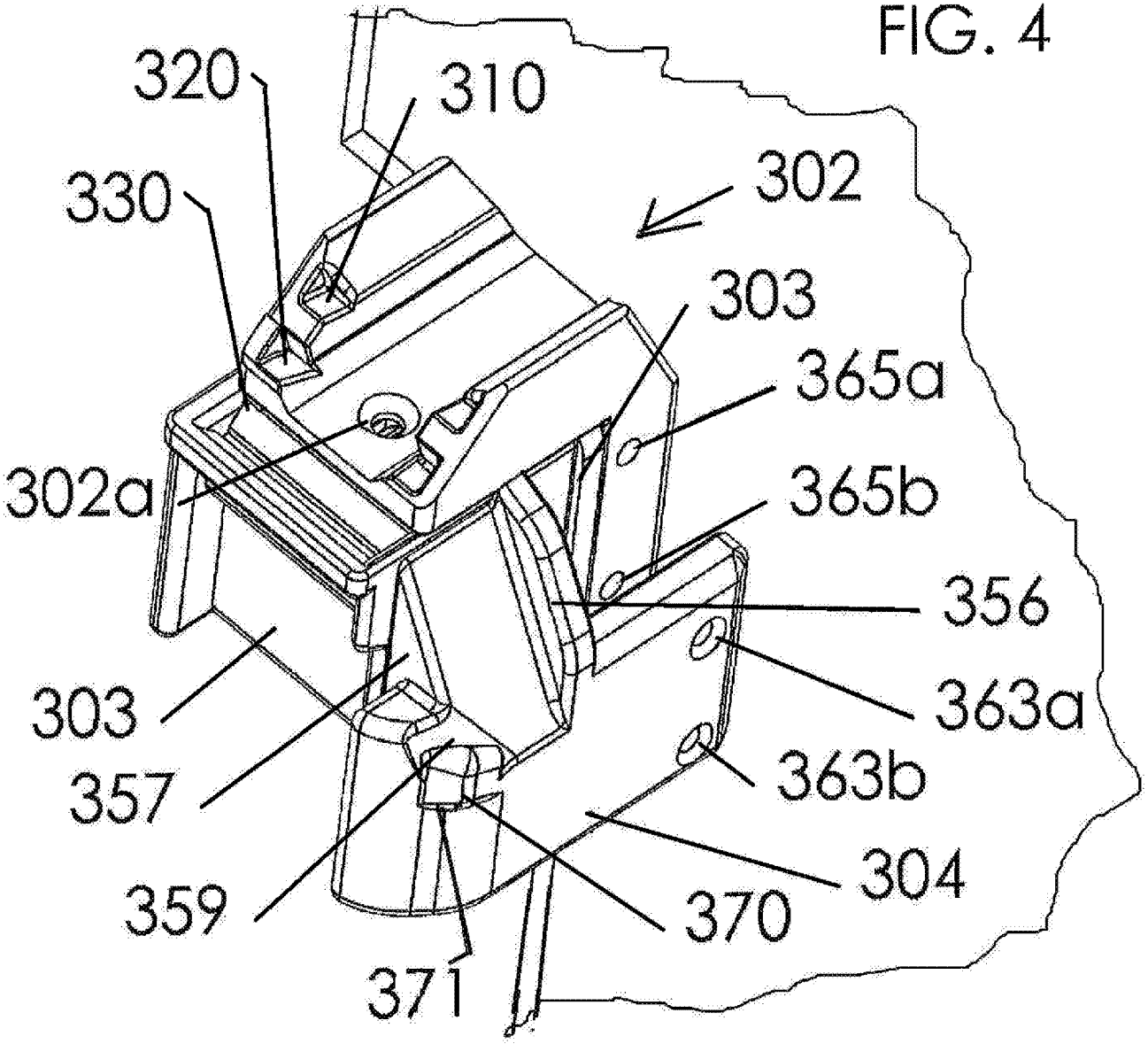
FIG. 4 is a fragmentary perspective view of a gun rest and reload guide of the embodiment of FIG. 3.
Figure 5:
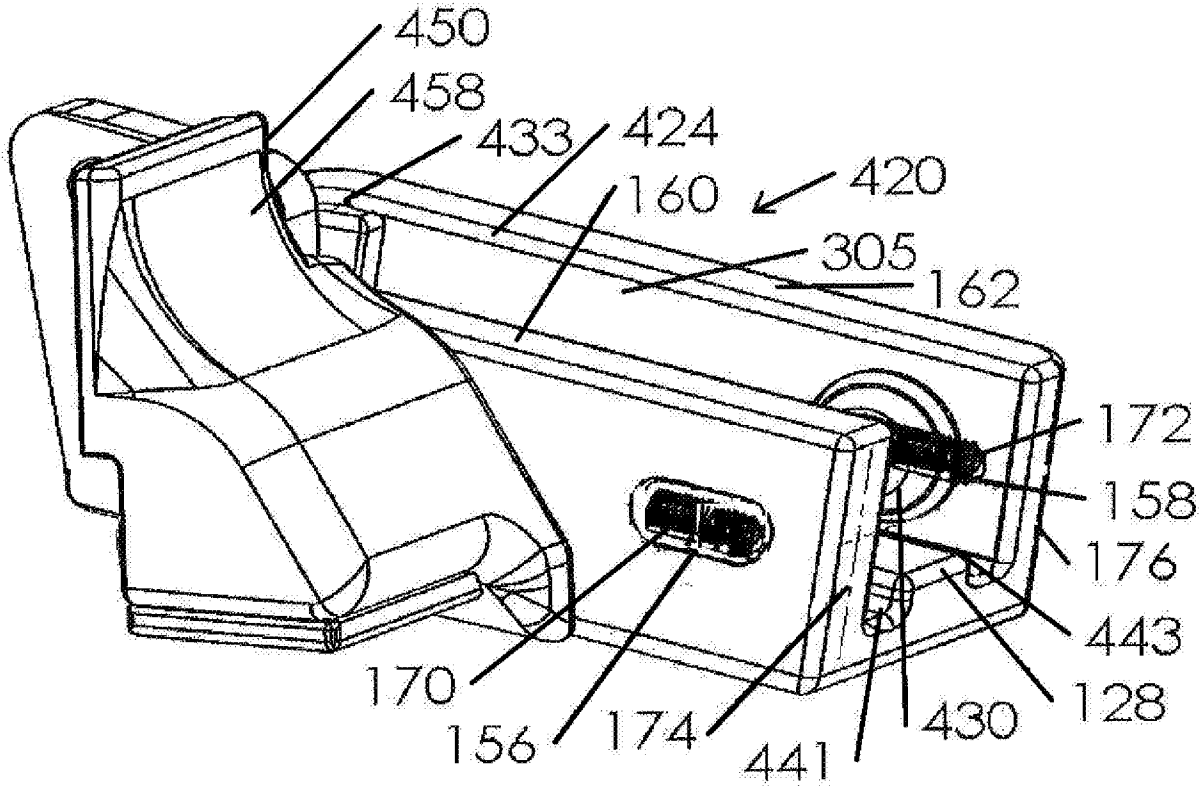
FIG. 5 is a fragmentary perspective view of a magazine mount of the embodiment of FIG. 3.

As shown in FIGS. 3A-4, the weapon rest 302 includes two rows of notches 310, 314 and 320, 324, which allow the rifle to be selectively supported in the rest at a tilted down orientation in a standby and safe direction toward the ground. The rest 302 is attached to the weapon shelf 303. The shelf 303 also includes a rearward tray 328, formed with or fastened to the rest of the shelf 303, with a recessed top surface 330 that can be used to rest the magazine well when in the standby and safe position with the barrel pointed down toward the ground.

The rail 307 is removed from FIG. 4 to see underlying components. The guide 304 includes a body 350 which includes an angled guide surface 354 sloping downward and laterally outward from a vertical centerline of the shield. In front of the angled guide surface is a backstop surface portion 356 perpendicular to the angled guide surface. The body 350 includes a clearance area 357 above a platform 359 that allows the magazine well 10*a* to be pivoted laterally outward above the platform 359 when the weapon is pivoted about its longitudinal axis counterclockwise (viewed by the user holding the stock and looking toward the barrel) and rolled and lifted out of the gun rest and lowered and the magazine well 10*a* is then moved forward to be movable along the angled guide surface 354 and the backstop surface portion 356. The body 350 includes an extension 361 that overlies the rail 307 and includes two fastener holes 363*a*, 363*b* for fastening the body 350 to the rail 307 and to the gun rest 302 via tapped holes 365*a*, 365*b* using two fasteners (not shown). The body 350 can also be attached to the shelf by fasteners (not shown) through holes 373*a*, 373*b*, 304*a*.

The gun rest 302 includes a block portion 302*c* that overlies a front of the shield 1. A fastener hole 302*d* received a fastener (not shown) that secures the gun rest 302, through the shield 1, and into a tapped hole (not shown) in the shelf 303.

In operation, once a spent magazine 11 is ejected from the rifle, the rifle is pivoted about its longitudinal centerline counterclockwise with the magazine well rotated about 30~90 degrees form a normal vertical orientation toward a horizontal orientation, depending on the varying curvature of different magazines, passing over the platform 359. The rifle is rolled and lifted out of the gun rest and then lowered and moved forward until the magazine well 10*a* touches the backstop surface portion 356, and can be slid down along the sloping surface 354. The backstop surface 356 and the sloping surface 354 are positioned to precisely align the bottom opening of the magazine well 10*a* with a re-load magazine 11 on the magazine mount 305, for a certain and user friendly matchup of the weapon to the reload magazine. Such a user friendly reload is important given the high stress situation of a potential firefight with an armed assailant.

FIGS. 3A-3C and 5 illustrate the mount 305 in more detail. The mount 305 includes a rectangular housing 420 having an open top 424. The housing includes an open rear end 428 to allow for ease of assembly of a latching mechanism 430. The latching mechanism 430 is substantially identical to the latching mechanism 130 shown in FIGS. 2A-2E, and described above, including the axle pin 134 that is fit through a spool 138, allowing the spool to freely rotate on the axle pin 134. Two washers 140*a*, 140*b* are fit onto the axle pin 134 on either side of the spool 138. The spool includes two disks 144*a*, 144*b* and a central cylindrical hub 146. The hub 146 and the disks together define a central cylindrical channel 150 for reception of the axle pin 134. When assembled, the axle pin 134 is fit at opposite ends into longitudinal slots 156, 158 through the sidewalls 160, 162 of the housing respectively. Provisions are made to prevent the axle pin 134 from moving axially once installed.

Two springs 170, 172 are located within longitudinal channels located in the sidewalls 160, 162 respectively and extend into the longitudinal slots 156, 158 respectively. The slot 158 can be closed on the outside surface of the sidewall 162. The springs are backed up at the rear end of the sidewalls 160, 162 by wall portions of the sidewalls. The springs 170, 172 exert a resilient force on ends 134*a*, 134*b* respectively of the axle pin 134, urging the axle pin and the spool forwardly in the housing. In the embodiments of FIGS. 3-9 the set screws 190, 192 are replaced by corner blocks 431, 433 that have underlying clearances 431*a*, 433*a* to receive the forward side lips of the magazine and a bottom of the housing includes troughs or tracks 441, 443 to guide the disks in longitudinal movement, i.e., the disks roll through the troughs.

The housing 420 is attached to, formed with, or 3D printed with, a base 450. The base can be fastened to a back of the shield 1. In this regard, the attachment block 451 can be fit onto a front surface of the shield 1. The block includes a fastener hole 453 that receives a fastener (not shown) that passes through a hole in the shield and engages a threaded hole in the front of the base 450 that is closest to the shield. The base 450 provides a curved rear surface 458 that acts to deflect an ejected magazine falling from the weapon away from the shield in a rearward direction.

Further, the housing 420 includes a flange 461 with a fastener hole 463 receiving a fastener (not shown) for fastening the housing to the rail 307 and/or through the rail and into a threaded hole in the attachment block 451.

As shown in FIG. 3, the attachment rail 307 can be provided along the edge of the shield 1. The attachment rail allows for the attachment of the weapon rest 302, the weapon shelf 303, the guide 304 and the mount 305 in a precise and rigid alignment. Also, the attachment rail 307 can be a military type, Picatinny rail for attachment of accessories, such as a flashlight or other objects or tools, such as a door breaching tool.

Figure 6:
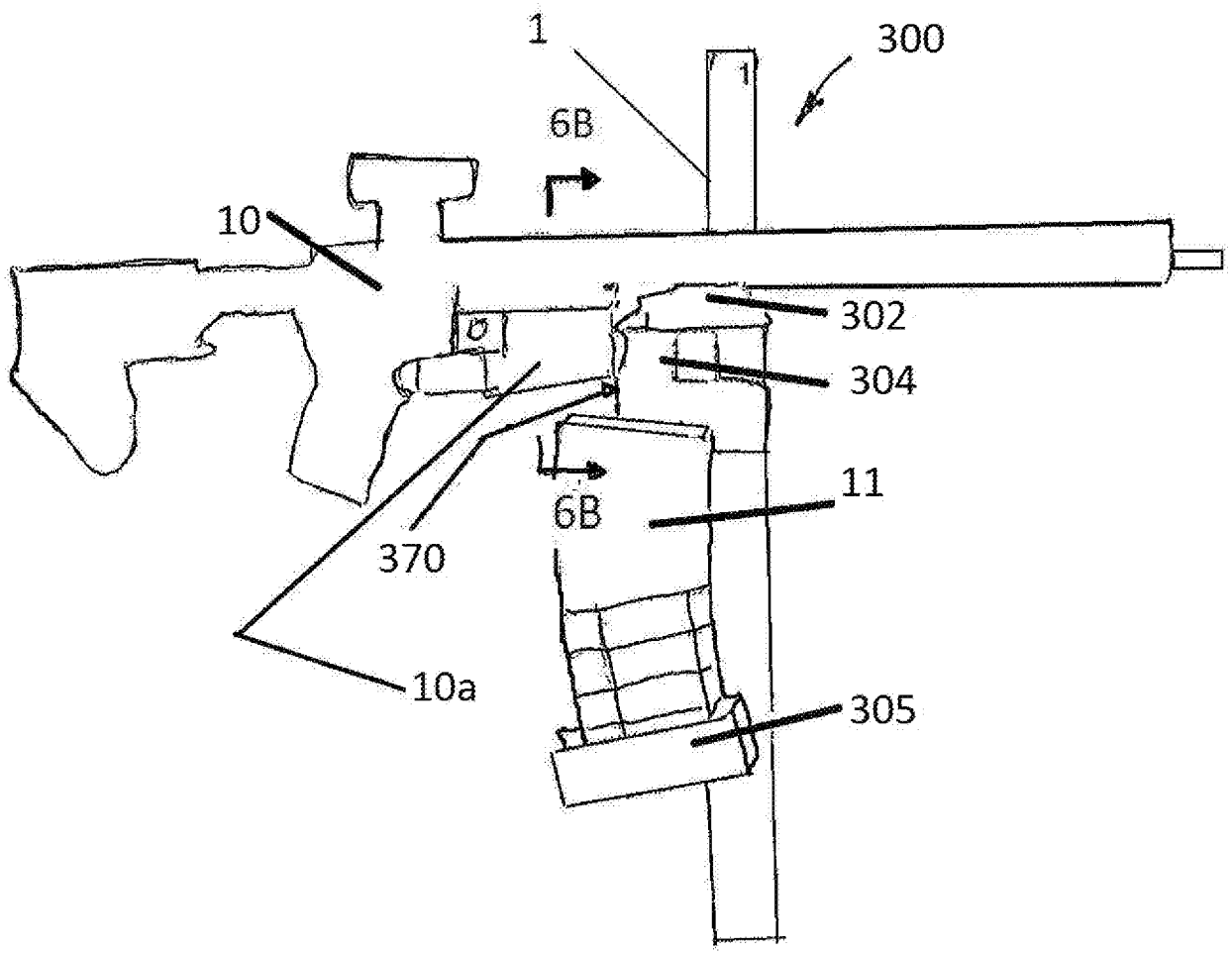
FIG. 6 is an elevation view of the embodiment of FIG. 3 with a weapon held by a user on the gun rest and a magazine in the magazine mount.

FIG. 6 displays the assembly 300 with a reload magazine 11 held by the magazine mount 305, having a top area of the magazine unobstructed for the engagement of the weapon 10 onto said magazine 11. The weapon 10 is held on the weapon rest 302. The guide 304 is shown containing the action release activator 370.

The magazine mount 305 provides proper control of the magazine to prevent undesired and uncontrolled movement. The control may be a one piece or a multitude piece design having a variety of magazine mount retainers for proper magazine control.

Other embodiments may have a latching or locking action by way of a spring-loaded ball plunger or similar locking device, or a form fitting base mount conforming to the shape of the magazine, holding the magazine by friction or resilient gripping. The shoulders of the locking device may be one piece or multiple pieces which provide lateral support for the upright mounted magazine that controls the magazine feed area. The magazine upper portion is controlled, resulting in minimal movement, for consistent reloading and weapon placement upon the reload magazine which is held stationary by the locking device.

The guide 304 provides the depressing mechanism or action release activator 370 working in coordination with the pathway required to release the magazine 11 from the magazine mount 5. The guide 304 is positioned between the weapon 10 rested in the high position on the weapon rest 302

(FIG. 3). When a user recognizes an empty magazine, the user ejects the empty magazine. The bolt is locked in its rear position. The user then pivots and lowers the weapon magazine well, insert area along the guide 304, controlling the weapon 10 to be seated upon the reload magazine 11 that is seated in the magazine mount 305. Upon seating the weapon 10 onto the magazine 11, the operator then pivots the weapon 10, in the rotary direction D in FIGS. 6A and 9, barrel end downward/stock end upward. This simultaneously pivots the magazine, independently of the magazine mount, causing the spring-loaded spool 146 to move rearward, compressing the springs 170, 172, and allowing the base of the magazine to separate from the magazine mount 305.

Figure 6A:
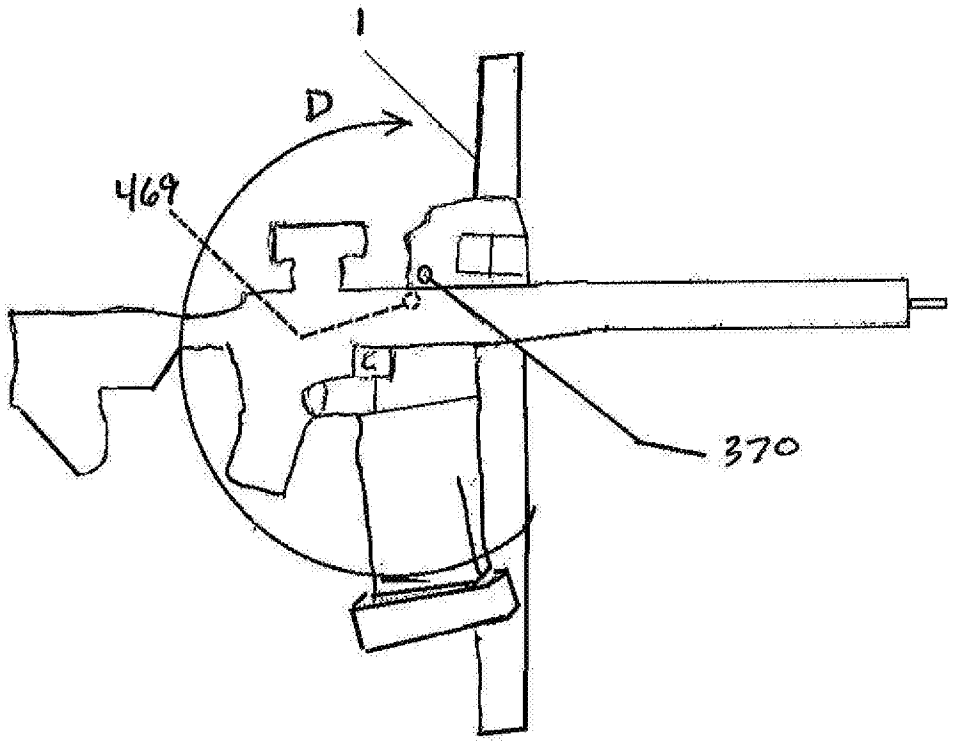
FIG. 6A is an elevation view of the embodiment of FIG. 3 with a weapon held by a user on engaged to a reload magazine on the magazine mount.
Figure 7:
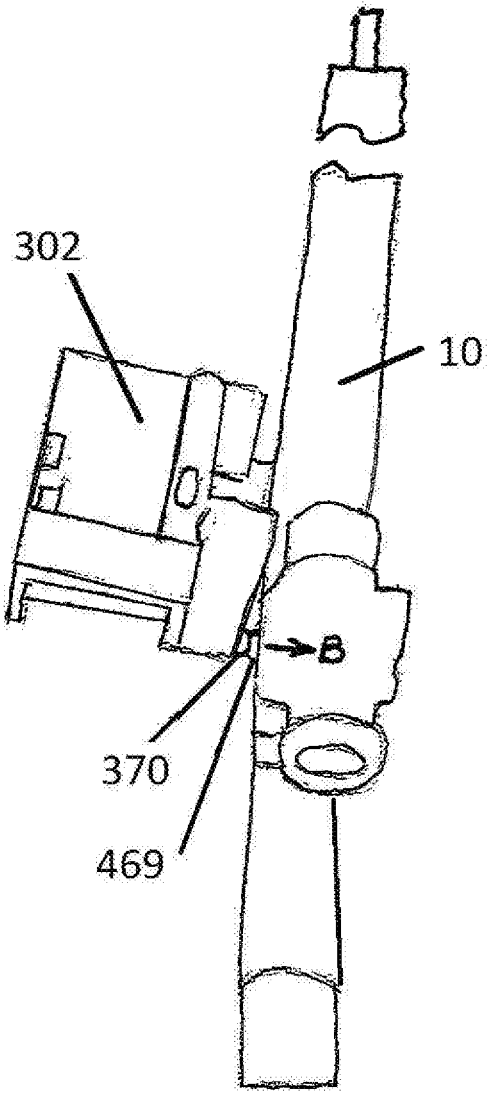
FIG. 7 is a fragmentary plan view of a portion of FIG. 6 with the rifle moved over the magazine mount.
Figure 6B:
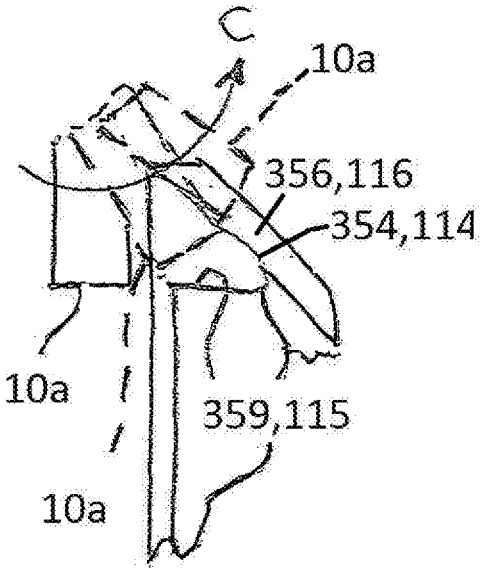
FIG. 6B is a schematic sectional view taken generally along line 6B-6B of FIG. 6.
Figure 8:
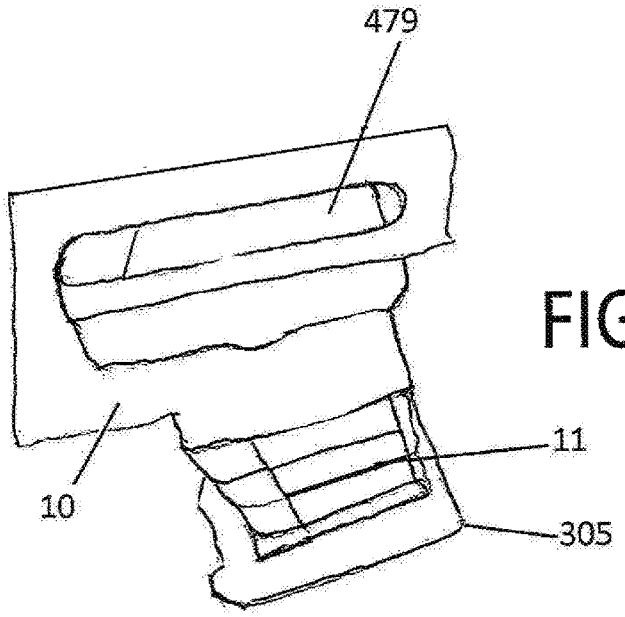
FIG. 8 is a fragmentary elevation view of a portion of FIG. 7 after initial engagement of a reload magazine on the magazine mount.
Figure 9:
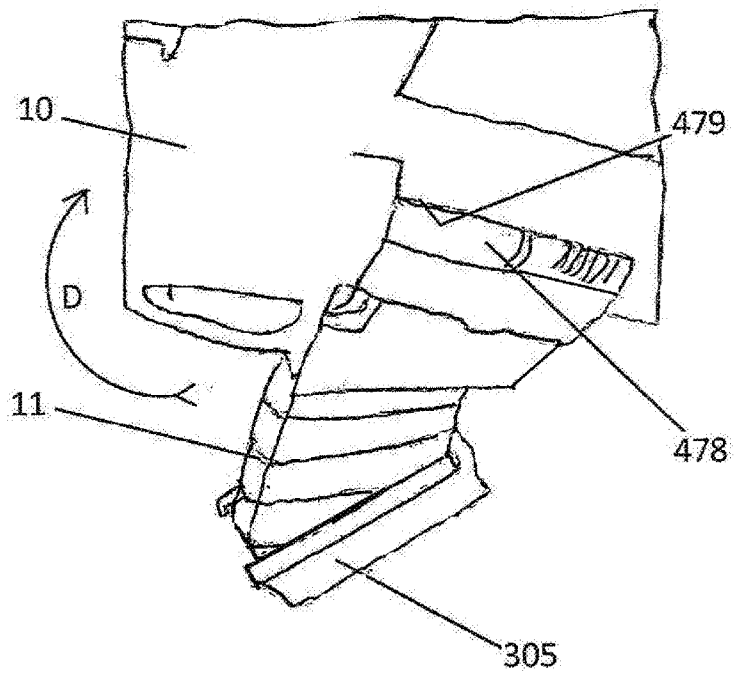
FIG. 9 is a fragmentary elevation view of a portion of FIG. 7 after the weapon is pivoted and the weapon bolt release activated.

During this pivoting movement, the weapon's action release button or bolt release button 469 is orbited to be is pressed inward in the direction B (FIG. 7) against the action release activator or bump 370 (FIGS. 6A and 7). The rifle's or weapon's bolt release (action release) button 469 moves upon the action release bump 370, having a gradual, ramped surface 371. The bolt release button 469 moves in an arc, passing the raised area of the ramped bump 370 and this button 469 is depressed into the weapon 10 in the direction B (FIG. 7), causing the bolt or action that is locked to the rear of the weapon (FIG. 8), to release, going forward and charging the weapon by putting a fresh ammunition cartridge or bullet 478 into the chamber 479 of the weapon 10 (FIG. 9).

The final result is a weapon and magazine just freed from the magazine mount, with the weapon in a fully loaded and ready to fire condition.

The drawings illustrate the adjustability in weapon system height with respect to the weapon action release button 469 of which should align with the guide 304. Additionally, the magazine well 10*a* of the weapon will in most instances be aligned with the upright magazine feed area in order to result in proper magazine insertion immediately followed by correct weapon movement resulting in the weapon action release button to move into the action release guide, to properly release the action forward to charge the weapon.

Some or all of the weapon rest, the weapon shelf, the guide, the rail, and the magazine mount can be composed of metal or plastic or other appropriate material. Some or all of these components can be 3D printed.

From the foregoing, it will be observed that numerous variations and modifications may be effected without departing from the spirit and scope of the invention. It is to be understood that no limitation with respect to the specific apparatus illustrated herein is intended or should be inferred.

All references, including publications, patent applications, and patents, cited herein are hereby incorporated by reference to the same extent as if each reference were individually and specifically indicated to be incorporated by reference and were set forth in its entirety herein, to the extent that the references are not contrary to the present disclosure.

The invention claimed is:

1. A magazine mount, comprising:

a mechanism to releasably hold a weapon magazine in a substantially upright orientation, wherein the mechanism to releasably hold the magazine comprises:

a rectangular housing having an open top and sidewalls;

an axle pin that is fit through a spool, allowing the spool to freely rotate on the axle pin, the axle pin is fit at opposite ends into longitudinal slots through each respective sidewall of the housing;

at least one spring backed up by a portion of the housing, the spring exerting a resilient force on the axle pin, urging the axle pin and the spool forwardly in the housing to press on a back end of a weapon magazine held in the housing;

the housing having a retainer at a forward end having an underlying clearance to receive a forward side lip of a weapon magazine.

2. The apparatus according to claim 1, wherein the at least one spring comprises two springs extending into the longitudinal slots respectively, the springs backed up by wall portions of the sidewalls.

3. The apparatus according to claim 2, wherein the retainer comprises blocks or pins at a forward end at the corners, each having an underlying clearance to receive the forward side lip of a weapon magazine.

4. The apparatus according to claim 3, wherein the spool includes two disks and the housing has a bottom floor having two longitudinal troughs, the disks configured to each roll in one of the troughs during installation or removal of a weapon magazine from the housing.

5. The apparatus according to claim 1, wherein the spool includes two disks and the housing has a bottom floor having two longitudinal troughs, the disks configured to each roll in one of the troughs during installation or removal of a weapon magazine from the housing.

6. The apparatus according to claim 1, wherein the retainer comprises blocks or pins at a forward end at the corners, each having an underlying clearance to receive the forward side lip of a weapon magazine.

* * * * *